United States Patent [19]

Bland et al.

[11] Patent Number: 4,927,391

[45] Date of Patent: May 22, 1990

[54] SHIFT MEANS FOR MARINE PROPULSION DEVICE

[75] Inventors: Gerald F. Bland, Glenview; Donald K. Sullivan, Waukegan, both of Ill.

[73] Assignee: Outboard Marine Corporation, Waukegan, Ill.

[21] Appl. No.: 677,569

[22] Filed: Dec. 3, 1984

[51] Int. Cl.[5] ..... B63H 5/13

[52] U.S. Cl. ..... 440/84; 440/75; 440/64

[58] Field of Search ..... 440/57, 53, 62, 64, 440/75, 84, 86, 112; 244/49; 192/67 R; 180/328, 89.14; 74/473 R, 480 B, 104, 501 R; 403/11, 13, 14

[56] References Cited

U.S. PATENT DOCUMENTS

| | | | |
|---|---|---|---|
| 1,861,714 | 6/1932 | Norviel | 74/501 R |
| 3,135,130 | 6/1964 | Bentley | 440/62 |
| 3,181,494 | 5/1965 | Kiekhaefer et al. | 440/75 |
| 3,183,880 | 5/1965 | Shimanckas | 440/64 |
| 3,924,557 | 12/1975 | Bloch | 440/75 |
| 4,231,316 | 11/1980 | Bland et al. | 440/86 |
| 4,269,282 | 5/1981 | Meacock et al. | 180/328 |
| 4,371,348 | 2/1983 | Blanchard | 440/52 |
| 4,493,662 | 5/1982 | Taguchi | 440/76 |

FOREIGN PATENT DOCUMENTS

| | | | |
|---|---|---|---|
| 964748 | 4/1950 | France | 74/501 R |
| 1293999 | 10/1972 | United Kingdom . | |
| 1499911 | 2/1978 | United Kingdom . | |
| 2098562 | 11/1982 | United Kingdom . | |

*Primary Examiner*—Joseph F. Peters, Jr.
*Assistant Examiner*—Edwin L. Swinehart
*Attorney, Agent, or Firm*—Michael, Best & Friedrich

[57] ABSTRACT

A marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to the pivot housing for pivotal movement with the pivot housing, and a mechanism extending between the pivot housing and the propulsion unit for actuating the transmission from the pivot housing, the mechanism being disengaged incident to disconnection of the propulsion unit from the pivot housing, and being engaged incident to connection of the propulsion unit to the pivot housing.

28 Claims, 4 Drawing Sheets

SHIFT MEANS FOR MARINE PROPULSION DEVICE

BACKGROUND OF THE INVENTION

The invention relates to shift means for marine propulsion devices, and more particularly, to shift means for inboard/outboard or stern drive marine propulsion devices Conventional inboard/outboard marine propulsion devices include a housing mounted on a boat transom, a gimbal ring mounted on the housing for pivotal movement relative to the housing about a generally vertical steering axis a pivot housing mounted on the gimbal ring for pivotal movement relative to the gimbal ring about a generally horizontal tilt axis, and a propulsion unit mounted on the pivot housing for pivotal movement with the pivot housing. The propulsion unit includes a propeller mounted on a propeller shaft, and a reversible transmission for transmitting forward or reverse motion to the propeller shaft from a drive shaft.

Prior means for shifting or actuating the transmission include a push-pull cable running from the boat to the propulsion unit. In order to disconnect the propulsion unit from the pivot housing, it is usually necessary to first disconnect the push-pull cable from the propulsion unit. This complicates removal of the propulsion unit from the pivot housing.

Attention is directed to the following U.S. Patents:

Bland et al. U.S. Pat. No. 4,231,316, issued Nov. 4 1980;

Smith U.S. Pat. No. 2,949,093, issued Aug. 16, 1960;

Fletcher U.S. Pat. No. 2,968,192, issued Jan. 17, 1961;

Fowler U.S. Pat. No. 1,263,052, issued Apr. 16, 1918;

Asbury U.S. Pat. No. 1,511,867, issued Oct. 14, 1924;

Asbury U.S. Pat. No. 1,511,868, issued Oct. 14, 1924;

Block U.S. Pat. No. 3.924.557, issued Dec. 9, 1975;

Liaaen U.S. Pat. No. 4,046,096, issued Sept. 6, 1977:

Blanchard U.S. Pat. No. 4,371,348, issued Feb. 1, 1983

Stevens U.S. Pat. No. 4,375,356, issued Mar. 1, 1983;

Payne U.S. Pat. No. 4,395,238, issued July 26, 1983; and

Kiekhaefer, et al. U.S. Pat. No. 3,181,494 issued May 4 1965.

SUMMARY OF THE INVENTION

The invention provides a marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to the pivot housing for pivotal movement with the pivot housing, and means extending between the pivot housing and the propulsion unit for actuating the transmission from the pivot housing the means being disengaged incident to disconnection of the propulsion unit from the pivot housing and being engaged incident to connection of the propulsion unit to the pivot housing.

In one embodiment the transmission actuating means includes a first member in the propulsion unit and operably connected to the transmission for actuation thereof, and a second member in the pivot housing and operably engaged with the first member for actuation of the first member so as to actuate the transmission the second member being engaged with the first member for automatic disengagement when the propulsion unit is disconnected from the pivot housing and for automatic engagement when the propulsion unit is connected to the pivot housing.

In one embodiment, the first member is a generally vertical shift rod mounted in the propulsion unit and having therein a recess, the shift rod being reciprocally vertically movable for actuating the reversible transmission, the second member includes projection means movably mounted in the pivot housing and received in the recess for moving the shift rod vertically the projection means being removed from the recess when the propulsion unit is disconnected from the pivot housing and being received in the recess when the propulsion unit is connected to the pivot housing, and the means for actuating the reversible transmission further includes means for moving the projection means vertically so as to move the shift rod vertically.

In one embodiment, the projection means include a first lever having one end pivotally connected to he pivot housing for pivotal movement about a generally horizontal axis, and an opposite end removably received in the recess, and the means for moving the projection means vertically includes means for rotating the first lever about the horizontal axis.

In one embodiment, the device further comprises a generally horizontal shaft pivotally mounted in the pivot housing for rotation about the horizontal axis, the one end of the first lever is fixedly attached to the shaft, and the means for rotating the first lever includes means for rotating the shaft abort the horizontal axis.

In one embodiment, the shaft has first and second opposite ends the first lever is fixedly attached to the first end of the shaft, and the means for rotating the shaft includes a second lever fixedly attached to the second end of the shaft, and push-pull means for moving the second lever so as to rotate the shaft about the horizontal axis.

In one embodiment the push-pull means includes a push-pull cable comprising a sheath having one end fixedly attached to the pivot housing near the second lever, and a cable core slidably received in the sheath and having an end extending from the one end of the sheath and being fixedly attached to the second lever such that movement of the cable core relative to the sheath moves the second lever so as to rotate the shaft about the horizontal axis, and operator actuated means for moving the cable core relative to the sheath.

In one embodiment, the device further comprises a gimbal housing having therein an opening and being adapted to be mounted on the boat transom, and a gimbal ring mounted on the gimbal housing for pivotal movement relative to the gimbal housing about the steering axis. The pivot housing is mounted on the gimbal ring for pivotal movement relative to the gimbal ring about the tilt axis the transom includes an opening an the push-pull cable extends from the pivot housing through the gimbal ring, the opening in the gimbal housing and the opening in the transom.

In one embodiment, the marine propulsion device further comprises conduit means receiving a portion of the push-pull cable and having a lower end sealingly communicating with the opening in the gimbal housing, and an upper end located above the lower end.

In one embodiment, the upper end of the conduit means includes a cap sealing the upper end and including an opening sealingly and slidingly receiving the push-pull cable.

The invention also provides a marine propulsion device comprising a housing having therein an opening and being adapted to be mounted on a boat transom having therein an opening a propulsion unit including a reversible transmission and being removably connected to the housing for pivotal movement relative to the housing about a generally vertical steering axis, and for pivotal movement relative to the housing about a generally horizontal tilt axis and means for actuating the transmission and including a push-pull cable operably connected to the transmission and extending through the opening in the housing and the opening in the transom, and conduit means receiving a portion of the push-pull cable and having a lower end sealingly communicating with the opening in the housing and an upper end located above the lower end.

The invention also provides a marine propulsion device comprising a housing having therein an opening and being adapted to be mounted on a boat transom having therein an opening a propulsion unit including a reversible transmission and removably connected to the housing for pivotal movement relative to the housing about a generally vertical steering axis, and for pivotal movement relative to the housing about a generally horizontal tilt axis and means for actuating the transmission and including a push-pull cable operably connected to the transmission and extending through the opening in the housing and the opening in the transom, and conduit means receiving a portion of the push-pull cable and having a lower end sealingly communicating with the opening in the housing and an upper end located above the lower end, the actuating means being disengaged incident to disconnection of the propulsion unit from the housing, and being engaged incident to connection of the propulsion unit to the housing.

A principal feature of the invention is the provision of means extending between the pivot housing and the propulsion unit for actuating the transmission from the pivot housing the means being disengaged incident to disconnection of the propulsion unit from the pivot housing, and being engaged incident to connection of the propulsion unit to the pivot housing. This allows disconnection of the propulsion unit from the pivot housing or connection of the propulsion unit to the pivot housing without requiring disconnection or connection of the shift means.

Another principal feature of the invention is the provision of a first member in the propulsion unit and operably connected to the transmission for actuation thereof, and a second member in the pivot housing and operably engaged with the first member for actuation of the first member so as to actuate the transmission the second member being engaged with the first member for automatic disengagement when the propulsion unit is disconnected from the pivot housing and for automatic engagement when the propulsion unit is connected to the pivot housing.

Another principal feature of the invention is the provision of a generally vertical shift rod mounted in the propulsion unit and having therein a recess, the shift rod being reciprocally vertically movable for actuating the transmission, and projection means movably mounted in the pivot housing and received in the recess for moving the shift rod vertically, the projection means being removed from the recess when the propulsion unit is disconnected from the pivot housing.

Another principal feature of the invention is the provision of conduit means receiving a portion of the push-pull cable and having a lower end sealingly communicating with the opening in the gimbal housing, and an upper end located above the lower end. This allows passage of the push-pull cable through the gimbal housing and the transom and into the boat while essentially preventing water from entering the boat through the opening in the gimbal housing.

Another principal feature of the invention is the provision of a cap sealing the upper end of the conduit means and including an opening sealingly and slidingly receiving the push-pull cable. This substantially prevents water from entering the boat through the conduit means in the event that the water in the conduit means is under enough pressure to rise to the upper end of the conduit means.

Various other features and advantages of the invention will become apparent to those skilled in the art upon review of the following detailed description, claims and drawings.

Figure 1:
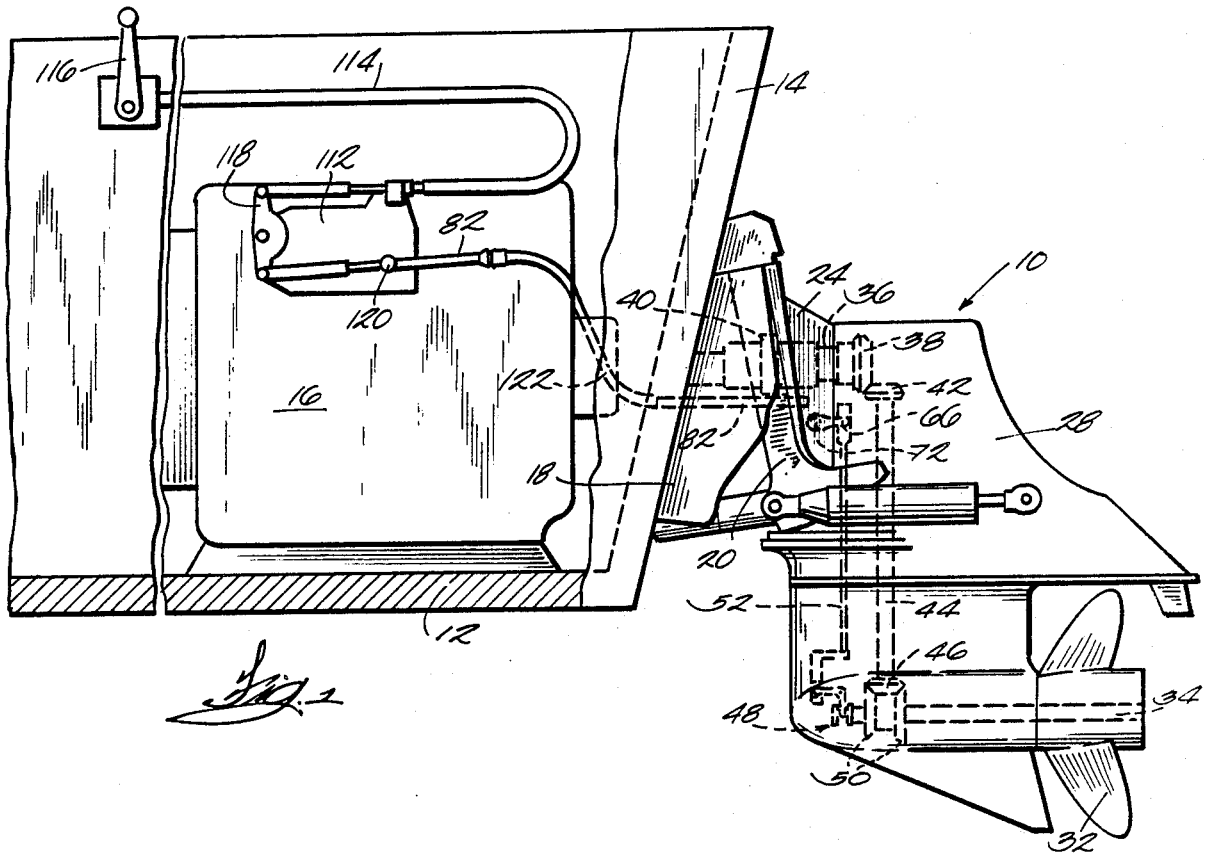
FIG. 1 is a side elevational view, partially cut away, of a marine propulsion device embodying the invention and mounted on a boat.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device 10 comprises an engine 16 securely mounted on the boat frame by suitable means such as rubber mounts (not shown). The marine propulsion device 10 also comprises a gimbal housing 18 mounted on the outer surface of the boat transom 14 and fixedly attached to the boat transom 14. The gimbal housing 18 can be attached to the boat transom 14 by any suitable means, such as bolts extending through the transom 14.

The marine propulsion device lo also comprises a gimbal ring 20 connected to the gimbal housing 18 for pivotal movement relative to the gimbal housing 18 about a generally vertical steering axis, and a pivot housing 24, connected to the gimbal ring 20 for pivotal movement relative to the gimbal ring 20 about a generally horizontal tilt axis. Such a construction is well known in the art and need not be described is greater detail.

Figure 2:
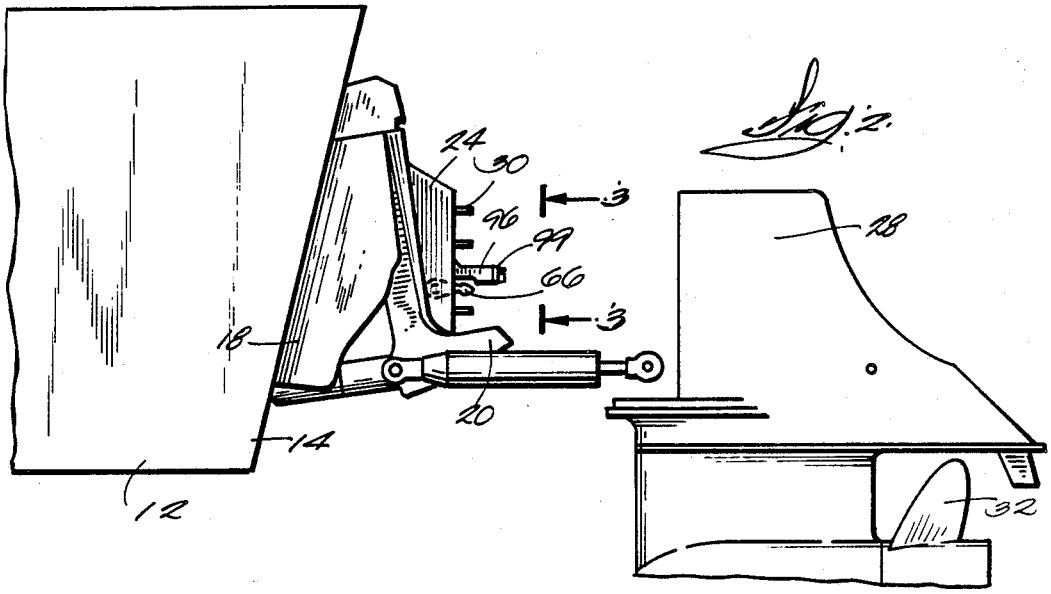
FIG. 2 is a view similar to FIG. 1 showing the propulsion unit disconnected from the pivot housing.

The marine propulsion device 10 also comprises a propulsion unit 28 removably connected to the pivot housing 24 for common pivotal movement of the propulsion unit 28 with the pivot housing 24. In the illustrated construction, the propulsion unit 28 is removably connected to the pivot housing 24 by a plurality of bolts 30 (see FIGS. 2 and 9 . The propulsion unit 28 includes a propeller 32 mounted on a propeller shaft 34, and a generally horizontal drive shaft 36 having one end removably connected to the engine 16 and an opposite end having thereon a bevel gear 38. A universal joint 40 in the horizontal drive shaft 36 allows pivotal movement of the drive shaft 36 with the propulsion unit 28. The bevel gear 38 drives a bevel gear 42 on the upper end of a vertical drive shaft 44. The lower end of the vertical drive shaft 44 has thereon a driving gear 46.

Figure 6:
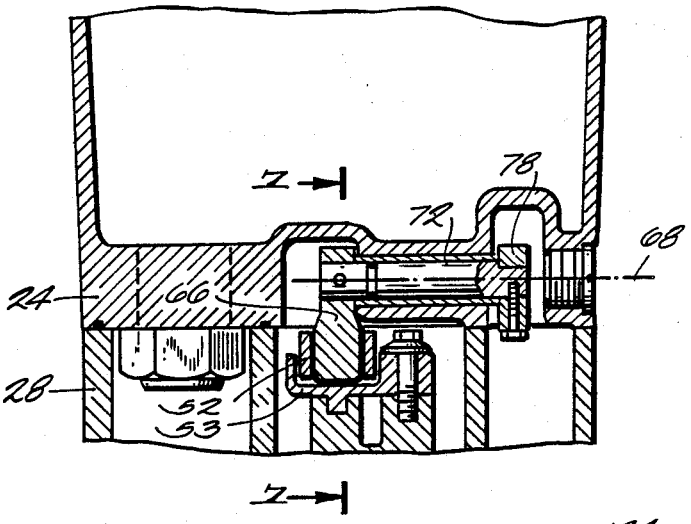
FIG. 6 is a cross-sectional view taken along line 6—6 in FIG. 3.
Figure 7:
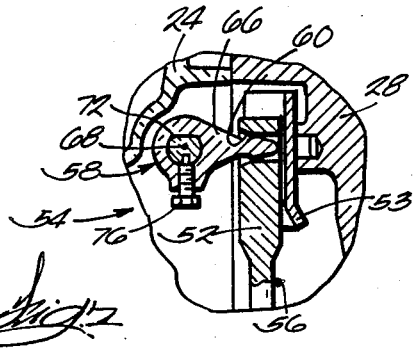
FIG. 7 is a cross-sectional view taken along line 7—7 in FIG. 6.

A reversible transmission 48 selectively clutches a pair of driven gears 50 to the propeller shaft 34 to transmit forward or reverse motion to the propeller shaft 34 from the driving gear 48. The reversible transmission 48 is of a known type, an example of which is disclosed in U.S. Bland et al. U.S. Pat. No. 4,231,316. The transmission 48 is actuated by vertical movement of a generally vertical shift rod 52 which is supported in the propulsion unit 28. In the illustrated construction, the upper end of the shift rod 52 has a rectangular cross-section, and, as best shown in FIGS. 6 and 7 a guide member 53 slidably receives the upper end of the shift rod 52 for preventing rotation and horizontal movement of the shift rod 52. The guide member 53 is fixedly attached to the propulsion unit 28.

As best shown in FIG. 7, the marine propulsion device 10 also comprises means 54 extending between the pivot housing 24 and the propulsion unit 28 for actuating the transmission 48 from the pivot housing 24, the actuating means 54 being disengaged when the propulsion unit 28 is disconnected from the pivot housing 24 and being engaged when the propulsion unit 28 is connected to the pivot housing 24. While various suitable means 54 can be employed for this purpose, in the preferred embodiment, such means 54 includes a first member 56 in the propulsion unit and operably connected to the transmission 48 for actuation thereof, and a second member 58 in the pivot housing 24 and operably engaged with the first member 56 for actuation of the first member 56 so as to actuate the transmission 48. The second member 58 is engaged with the first member 56 for automatic disengagement when the propulsion unit 28 is disconnected from the pivot housing 24 and for automatic engagement when the propulsion unit 28 is connected to the pivot housing 24.

In the preferred embodiment, as best seen in FIG. 7, the upper end of the shift rod 52 has therein a recess 60 which opens toward the pivot housing 24, and the first member 56 is the shift rod 52. The second member 58 includes projection means movably mounted in the pivot housing 24 and received in the recess 60 for moving the shift rod 52 vertically. The projection means is removed from the recess 60 when the propulsion unit 28 is disconnected from the pivot housing 24. In this embodiment, the actuating means 54 further includes means for moving the projection means vertically so as to move the shift rod 52 vertically. This vertical movement of the shift rod 52 actuates the transmission 48.

In the preferred embodiment, as best seen in FIG. 7, the projection means includes a first lever 66 having one end pivotally connected to the pivot housing 24 for pivotal movement about a generally horizontal axis 68 and an opposite end removably received in the recess 60 and the means for moving the projection means vertically includes means for rotating the first lever 66 about the horizontal axis 68. As best seen in FIG. 7, the end of the first lever 66 and the opening of the recess 60 are beveled to facilitate movement of the end of the first lever 66 into the recess 60.

As best seen in FIGS. 6 and 7, the marine propulsion device 10 further comprises a generally horizontal shaft 72 having opposite first and second ends and pivotally mounted in the pivot housing 24 for rotation about the horizontal axis 68. The one end of the first lever 66 includes a non-circular opening and the first end of the shaft 72 has a complimentary non-circular cross-section and is received in the opening in the end of the first lever 66 so that the first lever 66 is fixedly attached to the shaft 72. A bolt 76 further secures the first lever 66 to the shaft 72. As best shown in FIGS. 3 through 6, a second lever 78 is fixedly attached to the second end of the shaft 72 in a similar manner. The means for rotating the first lever 66 includes push-pull means 80 (see FIGS. 4 and 5) for moving the second lever 78 so as to rotate the shaft 72 about the horizontal axis 68.

Figure 14:
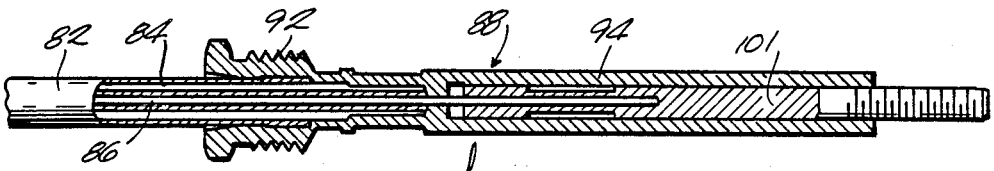
FIG. 14 is a cross-sectional view of the connecting member that connects the push-pull cable to the pivot housing.
Figure 4:
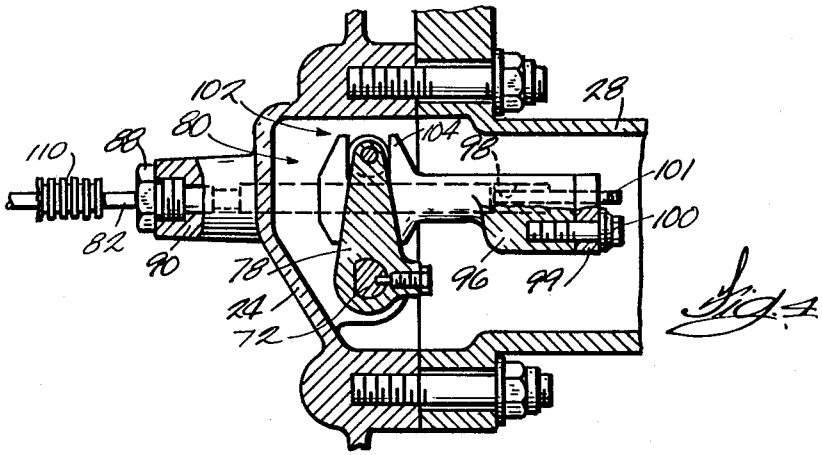
FIG. 4 is a cross-sectional view taken along line 4—4 in FIG. 3.

In the preferred embodiment, the push-pull means 80 includes a push-pull cable 82 (best shown in FIG. 14) including a sheath 84 and a core 86 slidably received in the sheath 84. The push-pull cable 82 extends into a connecting member 88 that is threaded into a projecting portion 90 of the pivot housing 24, as best shown in FIG. 4. The connecting member 88 (see FIG. 14) includes a threaded portion 92 threaded into the projecting portion 90 of the pivot housing 24, and a guide tube 94 extending rearwardly from the threaded portion 92. The connecting member 88 is crimped to the push-pull cable sheath 84 so that the sheath 84 does not move relative to the guide tube 94. The core 86 of the cable 82 slides freely within the guide tube 94 and the end of the cable core 86 is fixedly attached to a member 101 (see FIGS. 4 and 14) which also slides freely within the guide tube 94.

The push-pull means 80 also includes a guide member 96 (see FIGS. 4 and 5) having an aperture 98 slidably receiving the guide tube 94 so that the guide member 96 slides along the guide tube 94. A retainer member 99 is fixed to the end of the guide member 96 by a bolt 100, and the member 101 is threaded into the retainer member 99 so that the cable core 86 does not move relative to the guide member 96. Therefore, movement of the cable core 86 relative to the sheath 84 causes movement of the guide member 96 relative to the guide tube 94 since the guide tube 94 is fixed to the cable sheath 86 and the guide member 96 is fixed to the cable core 86.

Figure 5:
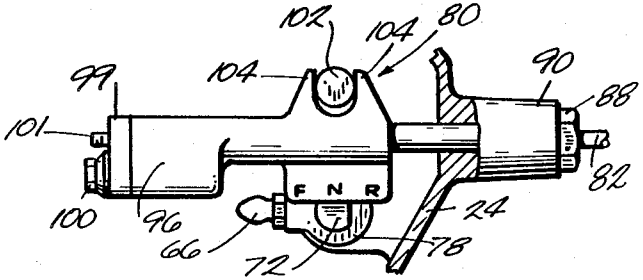
FIG. 5 is a cross-sectional view taken along line 5—5 in FIG. 3.
Figure 3:
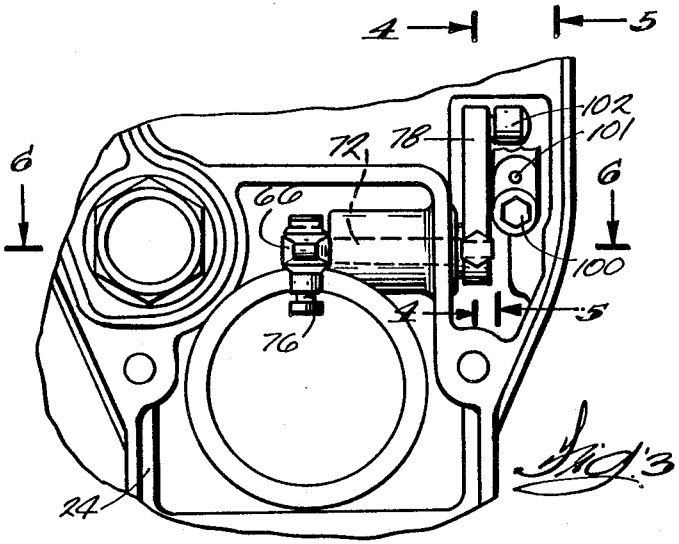
FIG. 3 is an end view of the pivot housing taken along line 3—3 in FIG. 2.

As best shown in FIGS. 3 through 5, the upper end of the second lever 78 has pivotally mounted thereon a horizontally extending roller 102. The guide member 96 includes a pair of vertically extending spaced apart projections 104 receiving the roller 102 therebetween. Horizontal movement of the guide member 96 causes generally horizontal pivotal movement of the roller 102 thereby moving the upper end of the second lever 78. This movement of the second lever 78 rotates the horizontal shaft 72, and rotation of the horizontal shaft 72 causes rotation of the first lever 66, which moves the shift rod 52 vertically so as to actuate the transmission 48. Therefore, movement of the cable core 86 relative to the cable sheath 84 moves the shift rod 52 vertically so as to actuate the transmission 48.

Figure 9:
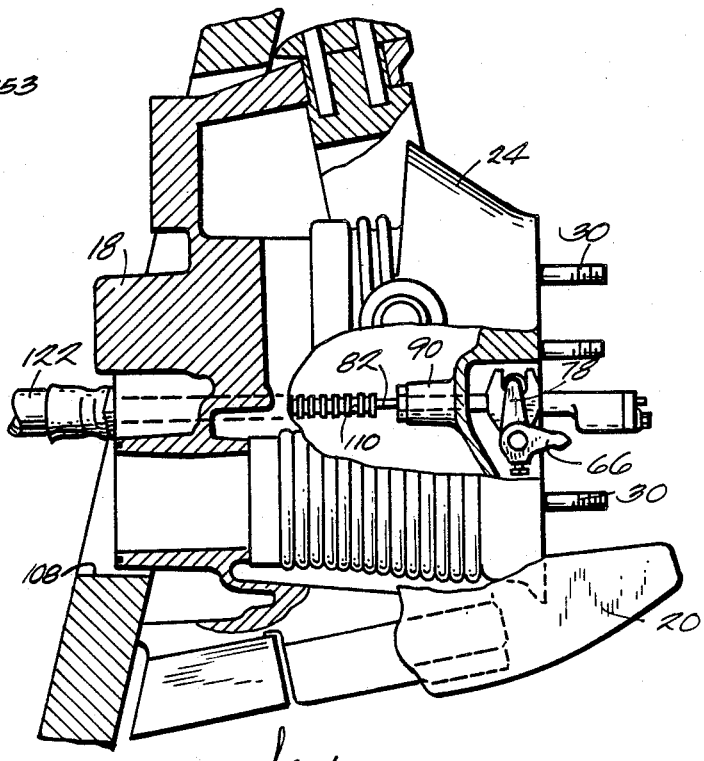
FIG. 9 is an enlarged cross-sectional view of the marine propulsion device.

The push-pull cable 82 extends forwardly from the pivot housing 24 into the boat 12 through an opening 106 (see FIG. 8) in the gimbal housing 18. The portion of the gimbal housing 18 including the opening 106 extends through an opening 108 in the transom 14, as best shown in FIG. 9. From a point adjacent the pivot housing 24 to a point within the boat 12, the push-pull cable 82 is covered by a protective nylon jacket 110 (see FIGS. 8 and 9). As best shown in FIG. 1, the forward end of the cable 82 is connected to a shift converter unit 112 which operably connects the cable 82 to a second push-pull cable 114 extending from a remote control lever 116 located forwardly in the boat 12 and operated by the boat operator. Such an arrangement is disclosed is U.S. Dretzka U.S. Pat. No. 4,403,970. The shift converter unit 112 can include ignition interruption means to assist shifting, such as described in the Dretzka patent. The shift converter unit 112 will be described herein only to the extent necessary for an understanding of the present invention.

The shift converter unit 112 includes a lever arm 118 having opposite first and second ends and being pivotally mounted for rotation about a point intermediate the opposite ends. The forward end of the cable sheath 84 is fixedly pivotally attached to the shift converter unit 112 by a trunnion 120, and the forward end of the cable core 86 is fixedly attached to the first or lower end of the lever 118 for movement therewith. Therefore, pivotal movement of the lever 118 causes forward or rearward movement of the cable core 86 relative to the cable sheath 84. The second push-pull cable 114 extending from the remote control lever 116 is similarly connected to the shift converter unit 112, with the sheath being fixedly attached to the unit 112, and the core being fixedly attached to the second or upper end of the lever 118 for movement therewith. Therefore, actuation of the remote control lever 116 moves the second or upper end of the lever 118 via the second push-pull cable 114, and movement of the lever 118 moves the cable core 86 relative to the cable sheath 84 for actuation of the transmission 48.

Figure 8:
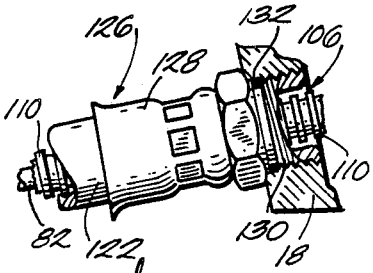
FIG. 8 is a fragmentary view of the push-pull cable and the lower end of the stand pipe.

As best shown in FIGS. 1, 8, and 9, the cable 82 and nylon jacket 110 extend through a stand pipe 122. The purpose of the stand pipe 122 is to prevent water entering the gimbal housing 18 through the opening 106 from entering the boat 12. The lower end of the stand pipe 122 sealingly communicates with the opening 106 in the gimbal housing 18 through which the cable 82 extends, and the upper end of the stand pipe 122 is located above the lower end and adjacent to the shift converter unit 112. The opening 106 is located such that it is frequently underwater, especially when the marine propulsion device 10 is not operating. Water passing through the opening 106 enters the stand pipe 122 instead of the boat 12, and because the upper end of the stand pipe 122 is located above the lower end, and above the normal water level relative to the boat 12, the water will usually not rise above the upper end.

The connection of the lower end of the stand pipe 122 to the gimbal housing 18 is best shown in FIG. 8. While the stand pipe 122 can be made of any suitable material, in the preferred embodiment, the stand pipe 122 is a wire reinforced rubber hose. In the preferred embodiment the lower end of the stand pipe 122 is connected to the gimbal housing 18 by a connecting member 126. The connecting member 126 includes a crimp fitting 128, and an externally threaded portion 130 integrally and fixedly attached to the crimp fitting 128. The opening 106 in the gimbal housing 18 is internally threaded, and the threaded portion 130 of the connecting member 126 is threadedly engaged in the opening 106. An O-ring 132 seals the joint between the gimbal housing 18 and the connecting member 126. The crimp fitting portion of the connecting member 126 is crimped to the lower end of the stand pipe 122. Thus, the lower end of the stand pipe 122 sealingly communicates with the opening 106. The push-pull 82 cable and surrounding nylon jacket 110 pass through the opening 106 and the connecting member 126 into the stand pipe 122.

Figure 15:
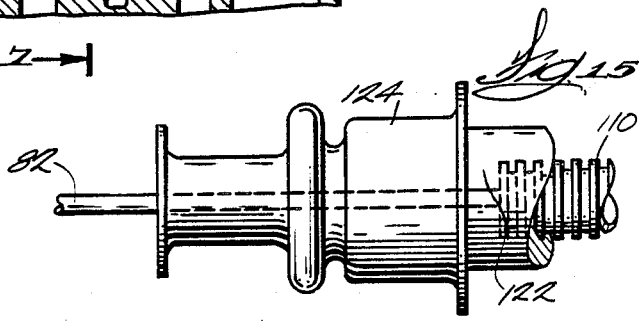
FIG. 15 is a view of the upper end of the stand pipe.

In the event that the water entering the lower end of the stand pipe 122 is under enough pressure to reach the upper end of the stand pipe 122, the upper end of the stand pipe 122 includes a cap 124 sealing the upper end and including an opening sealingly and slidingly receiving the cable 82. The jacket 110 surrounding the cable 82 does not extend beyond the cap 124. This is best shown in FIG. 15. The cap 124 substantially eliminates the possibility of water entering the boat 12 from the upper end of the stand pipe 122.

Illustrated in FIGS. 10 through 13 are alternative constructions of the means 54 extending between the pivot housing and the propulsion unit for actuating the transmission from the pivot housing.

Figure 10:
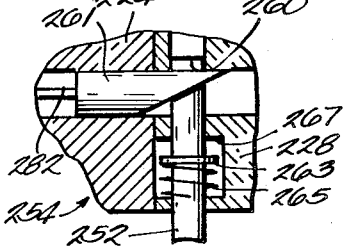
FIG. 10 is a cross-sectional view of an alternative construction of the means for actuating the transmission.

In FIG. 10 the means 254 for actuating the transmission includes a generally vertical shift rod 252 similar to the shift rod 52 of the preferred embodiment. The upper end of the shift rod 252 has therein a recess 260, and the actuating means 254 further includes a wedge member 261 having a wedge portion received in the recess 260. The wedge member 261 is slidably mounted in the pivot housing 224 for reciprocal horizontal movement relative to the pivot housing 224. A push-pull cable 282 moves the wedge member 261 relative to the pivot housing 224. The actuating means 254 further includes means biasing the shift rod 252 upwardly relative to the propulsion unit 228 such that the upwardly facing surface of the recess 260 abuts the downwardly facing surface of the wedge member 261. In the illustrated construction, the shift rod 252 has an C-ring 263 fixedly attached thereto, and the biasing means includes a spring 265 positioned between the propulsion unit 228 and the C-ring 263 for biasing the shift rod 252 upwardly. A stop surface 267 limits upward movement of the shift rod 252.

Figure 11:
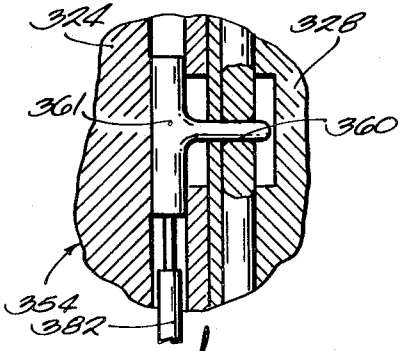
FIG. 11 is a cross-sectional view of an alternative construction of the means for actuating the transmission.

In FIG. 11, the actuating means includes, in the propulsion unit 328, a vertical shift rod 352 similar to the shift rod 52 of the preferred embodiment. The upper end of the shift rod 352 has a recess 360 therein. The actuating means 354 also includes a shift member 361 slidably mounted in the pivot housing 324 for reciprocal vertical movement relative to the pivot housing 324 and having an integral horizontal projecting portion received in the recess 360 for moving the shift rod 352 vertically. The actuating means 354 further includes a push-pull cable 382 operably connected to the shift member 361 for moving the shift member 361 vertically.

Figure 12:
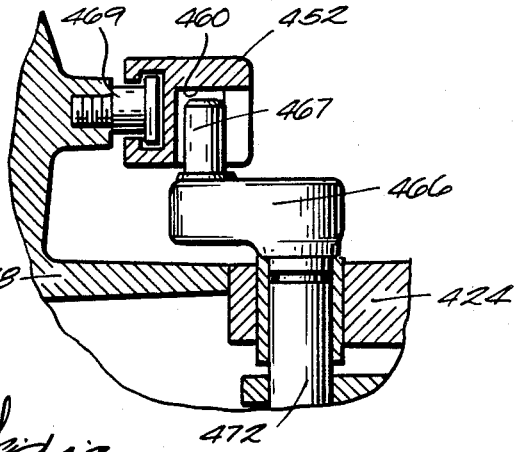
FIGS. 12 and 13 are cross-sectional views of an alternative construction of the means for actuating the transmission.
Figure 13:
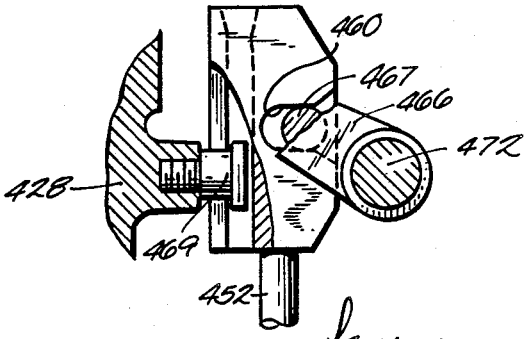

In FIGS. 12 and 13, the actuating means is very similar to the actuating means 54 of the preferred embodiment. FIG. 12 is a horizontal cross-section, and FIG. 13 is a vertical cross-section. A lever 466 is mounted on a horizontal shaft 472 for pivotal movement relative to the pivot housing 424. Rotation of the shaft 472 and lever 466 can be controlled in the same manner as in the preferred embodiment. A pin 467 having a circular cross-section extends sideways from the lever 466 and a recess 460 in the upper end of shift rod 452 receives the pin 467. Vertical movement of the pin 467 causes vertical movement of the shift rod 452. A pin 469 which is fixedly attached to the propulsion unit 428 has an enlarged head that is slidably received in a vertical slot in the upper end of the shift rod 452 for preventing rotation and horizontal movement of the shift rod 452.

It should be understood that the means extending between the pivot housing and the propulsion unit for actuating the transmission need not be a mechanical linkage. For example, the vertical shift rod can be electrically actuated, and the means extending between the pivot housing and the propulsion unit can be an electrical connection that is part of an electrical circuit for actuating the shift rod so as to actuate the transmission. For instance, the actuating means can include a male connector extending from the pivot housing, and a female connector in the propulsion unit and adapted to receive the male connector. The male and female connectors would be disengaged incident to disconnection of the propulsion unit from the pivot housing and engaged incident to connection of the propulsion unit to the pivot housing.

Various features and advantages of the invention are set forth in the following claims.

We claim:

1. A marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to said pivot housing for pivotal movement with said pivot housing, and means extending between said pivot housing and said propulsion unit for actuating said transmission from forwardly of said pivot housing and including a vertically shiftable member located in said propulsion unit and operably connected to said transmission for actuation thereof, a push-pull cable extending forwardly from said housing for actuation at a remote point, and means for automatically coupling said push-pull cable to said vertically shiftable member incident to connection of said propulsion unit to said pivot housing and for automatically uncoupling said push-pull cable and said vertically shiftable member incident to disconnection of said propulsion unit from said pivot housing.

2. A marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to said pivot housing for pivotal movement with said pivot housing, and means extending between said pivot housing and said propulsion unit for actuating said transmission from said pivot housing and including a vertically shiftable member located in said propulsion unit and operably connected to said transmission for actuation thereof, said actuating means being automatically disengaged incident to disconnection of said propulsion unit from said pivot housing, and being automatically engaged incident to connection of said propulsion unit to said pivot housing.

3. A marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to said pivot housing for pivotal movement with said pivot housing, and means extending between said pivot housing and said propulsion unit for actuating said transmission from said pivot housing, said transmission actuating means including a generally vertical shift rod mounted in said propulsion unit and having therein a recess, said shift rod being reciprocally vertically movable for actuating said reversible transmission, said actuation means for actuating said reversible transmission also including projection means movably mounted in said pivot housing and received in said recess for moving said shift rod vertically, said projection means being removed from said recess when said propulsion unit is disconnected from said pivot housing, and being received in said recess when said propulsion unit is connected to said pivot housing, and said means for actuating said reversible transmission further including means for moving said projection means vertically so as to move said shift rod vertically.

4. A marine propulsion device as set forth in claim 3 wherein said projection means includes a first lever having on end pivotally connected to said pivot housing for pivotal movement about a generally horizontal axis, and an opposite end removably received in said recess, and wherein said means for moving said projection means vertically includes means for rotating said first lever about said horizontal axis.

5. A marine propulsion device as set forth in claim 4 and further comprising a generally horizontal shaft pivotally mounted in said pivot housing for rotation about said horizontal axis, wherein said one end of said first lever is fixedly attached to said shaft, and wherein said means for rotating said first lever includes means for rotating said shaft about said horizontal axis.

6. A marine propulsion device as set forth in claim 5 wherein said shaft has first and second opposite ends, wherein said first lever is fixedly attached to said first end of said shaft, and wherein said means for rotating said shaft includes a second lever fixedly attached to said second end of said shaft, and push-pull means for moving said second lever so as to rotate said shaft about said horizontal axis.

7. A marine propulsion device as set forth in claim 6 wherein said push-pull means includes a push-pull cable comprising a sheath having one end fixedly attached to said pivot housing near said second lever and a cable core slidably received in said sheath and having an end extending from said one end of said sheath and being fixedly attached to said second lever such that movement of said cable core relative to said sheath moves said second lever so as to rotate said shaft about said horizontal axis, and operator actuated means for moving said cable core relative to said sheath.

8. A marine propulsion device as set forth in claim 7 and further comprising a gimbal housing having therein an opening and being adapted to be mounted on the boat transom, and a gimbal ring mounted on said gimbal housing for pivotal movement relative to said gimbal housing about said steering axis, wherein said pivot housing is mounted on said gimbal ring for pivotal movement relative to said gimbal ring about said tilt axis, wherein the transom includes an opening, and wherein said push-pull cable extends from said pivot housing through said gimbal ring, said opening in said gimbal housing, and the opening in the transom.

9. A marine propulsion device as set forth in claim 8 wherein said marine propulsion device further comprises conduit means receiving a portion of said push-pull cable and having a lower end sealingly communicating with said opening in said gimbal housing, and an upper end located above said lower end.

10. A marine propulsion device as set forth in claim 9 wherein said upper end of said conduit means includes a cap sealing said upper end and including an opening sealingly and slidingly receiving said push-pull cable.

11. A marine propulsion device comprising a pivot housing adapted to be mounted on a boat transom for pivotal movement relative to the boat transom about a generally vertical steering axis and for pivotal movement relative to the boat transom about a generally horizontal tilt axis, a propulsion unit including a reversible transmission and being removably connected to said pivot housing for pivotal movement with said pivot housing, a generally vertical shift rod mounted in said propulsion unit and having therein a recess, said shift rod being reciprocally vertically movable for actuating said reversible transmission, projection means movably mounted in said pivot housing and received in said recess for moving said shift rod vertically, said projection means being removed from said recess incident to disconnection of said propulsion unit from said pivot housing, and being received in said recess incident to connection of said propulsion unit to said pivot housing, and means for moving said projection means so as to move said shift rod vertically.

12. A marine propulsion device as set forth in claim 11 wherein said projection means includes a first lever having one end pivotally connected to said pivot housing for pivotal movement about a generally horizontal axis and an opposite end removably received in said recess, and wherein said means for moving said projection means vertically includes means for rotating said first lever about said horizontal axis.

13. A marine propulsion device as set forth in claim 12 and further comprising a generally horizontal shaft pivotally mounted in said pivot housing for rotation about said horizontal axis, wherein said one end of said first lever is fixedly attached to said shaft, and wherein said means for rotating said first lever includes means for rotating said shaft about said horizontal axis.

14. A marine propulsion device as set forth in claim 13 wherein said shaft has first and second opposite ends, wherein said first lever is fixedly attached to said first end of said shaft, and wherein said means for rotating said shaft includes a second lever fixedly attached to said second end of said shaft, and push-pull means for moving said second lever so as to rotate said shaft about said horizontal axis.

15. A marine propulsion device as set forth in claim 14 wherein said push-pull means includes a push-pull cable comprising a sheath having one end fixedly attached to said pivot housing near said second lever, and a cable core slidably received in said sheath and having an end extending from said one end of said sheath and being fixedly attached to said second lever such that movement of said cable core relative to said sheath moves said second lever so as to rotate said shaft about said horizontal axis, and operator actuated means for moving said cable core relative to said sheath.

16. A marine propulsion device as set forth in claim 15 and further comprising a gimbal housing having therein an opening and being adapted to be mounted on the boat transom, and a gimbal ring mounted on said gimbal housing for pivotal movement relative to said gimbal housing about said steering axis, wherein said pivot housing is mounted on said gimbal ring for pivotal movement relative to said gimbal ring about said tilt axis, wherein the transom includes an opening and wherein said push-pull cable extends from said pivot housing through said gimbal ring, said opening in said gimbal housing, and the opening in the transom.

17. A marine propulsion device as set forth in claim 16 wherein said marine propulsion device further comprises conduit means receiving a portion of said push-pull cable and having a lower end sealingly communicating with said opening in said gimbal housing and an upper end located above said lower end.

18. A marine propulsion device as set forth in claim 17 wherein said upper end of said conduit means includes a cap sealing said upper end and including an opening sealingly and slidingly receiving said push-pull cable.

19. A marine propulsion device comprising a pivot housing adapted to be mounted on a boat transom for pivotal movement relative to the boat transom about a generally vertical steering axis, and for pivotal movement relative to the boat transom about a generally horizontal tilt axis, a propulsion unit including a reversible transmission and being removably connected to said pivot housing for pivotal movement with said pivot housing, and means extending between said pivot housing and said propulsion unit for actuating said transmission from said pivot housing and including a member located in said pivot housing and having a surface movable vertically in response to operator actuation of said actuation means, said actuation means being automatically disengaged incident to disconnection of said propulsion unit from said pivot housing, and being automatically engaged incident to connection of said propulsion unit to said pivot housing.

20. A marine propulsion device comprising a housing having therein an opening and being adapted to be mounted on a boat transom having therein an opening a propulsion unit including a reversible transmission and removably connected to said housing for pivotal movement relative to said housing about a generally vertical steering axis, and for pivotal movement relative to said housing about a generally horizontal tilt axis, and means for actuating said transmission and including a vertical movement member located in said propulsion unit and operable connected to said transmission, a push-pull cable extending forwardly from said housing for actuation at a remote point and extending through said opening in said housing and the opening in the transom, means for automatically coupling said push-pull cable to said vertically movable member incident to connection of said propulsion unit to said housing and for automatically uncoupling said push-pull cable and said vertically movable member incident to disconnection of said propulsion unit from said housing and conduit means receiving a portion of said push-pull cable, and having a lower end sealingly communicating with said opening in said housing, and an upper end located above said lower end.

21. A marine propulsion device comprising a housing having therein an opening and being adapted to be mounted on a boat transom having therein an opening, a propulsion unit including a reversible transmission and being removably connected to said housing for pivotal movement relative to said housing about a generally vertical steering axis, and for pivotal movement relative to said housing about a generally horizontal tilt axis, and means for actuating said transmission and including a push-pull cable including an inner core and an outer sheath enclosing said core, said cable being operably connected to said transmission and extending through said opening in said housing and the opening in the transom, and conduit means receiving a portion of said push-pull cable and extending forwardly of the transom with a lower end sealingly communicating with said opening in said housing, and an upper end located above said lower end and forwardly of the transom, said upper end of said conduit means including a cap sealing said upper end and including an opening sealingly and slidingly receiving said push-pull cable, said marine propulsion device further including a pivot housing mounted on said housing for pivotal movement relative to said housing about said steering axis, and for pivotal movement relative to said housing about said tilt axis, wherein said propulsion unit is removably connected to said pivot housing for pivotal movement with said pivot housing, wherein said actuating means further includes, mounted in said propulsion unit, a generally vertical shift rod having therein a recess and being reciprocally vertically movable for actuating said reversible transmission, and, movably mounted in said pivot housing, projection means received in said recess for moving said shift rod vertically, said projection means being removed from said recess incident to disconnection of said propulsion unit from said pivot housing, and being received in said recess incident to connection of said propulsion unit to said pivot housing, and wherein said push-pull cable is operably connected to said projection means for moving said projection means so as to move said shift rod vertically.

22. A marine propulsion device as set forth in claim 21 wherein said projection means includes a first lever having one end pivotally connected to said pivot housing for pivotal movement about a generally horizontal axis, and an opposite end removably received in said recess, and wherein said push-pull cable rotates said first lever about said horizontal axis.

23. A marine propulsion device as set forth in claim 22 wherein said actuating means further includes a generally horizontal shaft pivotally mounted in said pivot housing for rotation about said horizontal axis, wherein said one end of said first lever is fixedly attached to said shaft, and wherein said push-pull cable rotates said shaft about said horizontal axis.

24. A marine propulsion device as set forth in claim 23 wherein said shaft has first and second opposite ends, and said first lever is fixedly attached to said first end of said shaft, wherein said actuating means further includes a second lever fixedly attached to said second end of said shaft, and wherein said push-pull cable moves said second lever so as to rotate said shaft about said horizontal axis.

25. A marine propulsion device comprising a housing having therein an opening and being adapted to be mounted on a boat transom having therein an opening, a propulsion unit including a reversible transmission and being removably connected to said housing for pivotal movement relative to said housing about a generally vertical steering axis, and for pivotal movement relative to said housing about a generally horizontal tilt axis, and means for actuating said transmission and including a push-pull cable including an inner core and an outer sheath enclosing said core, said cable being operably connected to said transmission and extending through said opening in said housing and the opening in the transom, and conduit means receiving a portion of said push-pull cable and extending forwardly of the transom with a lower end sealingly communicating with said opening in said housing, and an upper end located above said lower end and forwardly of the transom, said upper end of said conduit means including a cap sealing said upper end and including an opening sealingly and slidingly receiving said push-pull cable, said actuating means being disengaged incident to disconnection of said propulsion unit from said housing, and being engaged incident to connection of said propulsion unit to said housing, said marine propulsion device further including a pivot housing mounted on said housing for pivotal movement relative to said housing about said steering axis, and for pivotal movement relative to said housing about said tilt axis, wherein said propulsion unit is removably connected to said pivot housing for pivotal movement with said pivot housing, wherein said actuating means further includes, mounted in said propulsion unit, a generally vertical shift rod having therein a recess and being reciprocally vertically movable for actuating said reversible transmission, and, movably mounted in said pivot housing, projection means received in said recess for moving said shift rod vertically, said projection means being removed from said recess incident to disconnection of said propulsion unit from said pivot housing, and being received in said recess incident to connection of said propulsion unit to said pivot housing, and wherein said push-pull cable is operably connected to said projection means for moving said projection means so as to move said shift rod vertically.

26. A marine propulsion device as set forth in claim 25 wherein said projection means includes a first lever having one end pivotally connected to said pivot housing for pivotal movement about a generally horizontal axis, and an opposite end removably received in said recess, and wherein said push-pull cable rotates said first lever about said horizontal axis.

27. A marine propulsion device as set forth in claim 26 wherein said actuating means further includes a generally horizontal shaft pivotally mounted in said pivot housing for rotation about said horizontal axis, wherein said one end of said first lever is fixedly attached to said shaft, and wherein said push-pull cable rotates said shaft about said horizontal axis.

28. A marine propulsion device as set forth in claim 27 wherein said shaft has first and second opposite ends, and said first lever is fixedly attached to said first end of said shaft, wherein said actuating means further includes a second lever fixedly attached to said second end of said shaft, and wherein said push-pull cable moves said second lever so as to rotate said shaft about said horizontal axis.

* * * * *